US005477624A

United States Patent [19]

Haessner et al.

[11] Patent Number: 5,477,624

[45] Date of Patent: Dec. 26, 1995

[54] TWO-WIRE CYLINDER DRYER

[75] Inventors: Winfried Haessner; Wilhelm Wanke; Peter Kahl, all of Heidenheim; Wolfgang Müller, Giengen, all of Germany

[73] Assignee: J. M. Voith GmbH, Heidenheim, Germany

[21] Appl. No.: 209,411

[22] Filed: Mar. 10, 1994

[30] Foreign Application Priority Data

Mar. 11, 1993 [DE] Germany ..... 43 07 625.4
Feb. 16, 1994 [DE] Germany ..... 44 04 726.6

[51] Int. Cl.[6] ..... D06F 58/00

[52] U.S. Cl. ..... 34/117; 34/120; 34/123

[58] Field of Search ..... 34/114, 116, 117, 34/118, 120, 123

[56] References Cited

U.S. PATENT DOCUMENTS 4,502,231 3/1985 Fismann et al. ..... 34/123
4,505,052 3/1985 Oswald et al. ..... 34/116
4,694,587 9/1987 Eskelinen ..... 34/23
4,893,741 1/1990 Heinzmann ..... 34/123
4,996,782 3/1991 Eivola ..... 34/114
5,074,278 12/1991 Turcotte ..... 34/116

FOREIGN PATENT DOCUMENTS 0472513 2/1992 European Pat. Off. ..... D21F 5/18
3818600 12/1988 Germany ..... D21F 5/02

*Primary Examiner*—Denise L. Gromada
*Assistant Examiner*—Susanne C. Tinker
*Attorney, Agent, or Firm*—Baker & Daniels

[57] ABSTRACT

In a two-wire cylinder dryer, the wire guide rolls are so arranged that the web and wire proceed jointly from the first cylinder to the wire guide roll. An air carrier box is arranged in the shaft contained between two cylinders. The air carrier box has an air channel connecting the area of the leaving point A with an opposite pressure zone. Hot air flows into the air channel through a driver nozzle, so that in the area of the leaving point there is a vacuum zone created which is outwardly bounded by a sealing strip. The pressure zone is bounded by further sealing strips.

18 Claims, 7 Drawing Sheets

TWO-WIRE CYLINDER DRYER

BACKGROUND OF THE INVENTION

The invention concerns a two-wire cylinder dryer for drying a fiber web, notably in a paper machine.

For prior art, reference is made to the following documents:

D1: DE 36 30 570 (U.S. Pat. No. 4,694,587)

D2: DE 38 18 600

D3: EP 0 472 513

Features which the object of the present application and the design known from D2 have in common include:

1. As it leaves each drying cylinder, the web to be dried runs at first some distance along with the respective wire, mostly up to a wire guide roll. Hence, the web is supported by the wire up to that point. Only then continues the web freely to the following cylinder of the other cylinder row. Thus, the "free web trains" (i.e., the stretches of web travel where the web is not supported), are relatively short. This precludes the risk of web flutter and web breaks.

2. An air carrier box is provided on the peripheral part not touched by the wire and creates in the area of the point where the web and wire leave the cylinder a vacuum zone so as to separate the web from the cylinder and subject the wire to suction.

3. Provided on the opposite side of the air carrier box are blow openings for blowing preferably hot, dry air through wire into the so-called pocket.

A "pocket," as is generally known, is defined by the part of the cylinder circumference that is free of paper, by the paper travel stretches to and from this cylinder, and by the stretch of wire travel located opposite this cylinder (between two cylinders of the other cylinder row). The hot, dry air serves the swift removal of the billows emanating from the web. Across the machine width, variable air quantities can be supplied to individual zones in order to achieve a maximally uniform drying of the web across its entire width.

A problem results from the fact that the operating speed of modern paper machines is supposed to be raised to ever higher speeds (to the order of 1500 m/min and higher). This requires increasing the drying capacity per drying cylinder, and thus increasing the amount of dry air needed for billows removal. This requirement can be met only insufficiently with the prior configurations. It is either very difficult or impossible to direct the increased amounts of air to where they are needed for billows removal, namely into the pockets. With several prior designs, a major part of the supplied air fails, due to the elevated wire travel speed, to proceed through the mesh of the wire into the pockets, but is transported by the wire directly outside instead. Or, an unfavorable design (for instance according to D2) prevents a swift escape of billows-enriched air from the pockets.

The problem underlying the invention is to raise the drying capacity of the prior two-wire cylinder dryers by means of an improved air carrier box design which makes it possible to blow air quantities greater than heretofore into the pockets for billows removal and to pass them from there again outside.

SUMMARY OF THE INVENTION

This problem is solved according to the teachings of the present invention. Common to the disclosed embodiments is that the air carrier box, on the wire path from the wire guide roll to the second cylinder, and at that, as near as possible to the wire leaving point from the wire guide roll, creates a pressure zone which is distinctly bounded by means of a sealing gap. The drying air is thereby forced to flow at a relatively large distance from the following second cylinder through the wire and into the pocket. Besides, a sufficiently large space exists in the case of the two solutions between the air carrier box and the following second cylinder, so that the billows-enriched drying air is allowed to escape from the pocket to the outside, at least for the most, along the shortest path, namely again through the wire. In other words: at least extensively avoided is that the billows-enriched drying air must flow sideways out of the pockets. Reduced thereby is the risk of paper web edge flutter in the zones where the web runs freely to the following cylinder. Thus, the risk of web break is being reduced even more so than before.

With the solution according to the present invention, this favorable effect is created, among others, in that the air carrier box (relative to the direction of wire travel) features (arranged a great distance from the following second cylinder) a wall which diverges from the path of wire travel. This wall forms in conjunction with the following second cylinder a chimney type space which provides a sufficiently large flow cross section for the outflowing air enriched with water vapor.

The same favorable result is achieved with a second embodiment in that the sealing gap bounding the pressure zone is exclusively formed by a bulge on the air carrier box. The distance between the bulge and the passing wire may amount to between zero and a few millimeters; contact is preferably not established. The bulge is preferably part of a pipe which, the same as the entire air carrier box, extends crosswise through the dryer. This pipe may serve as a support pipe for stiffening the air carrier box and likewise for supplying drying air.

Achieved with all embodiments of the invention is that, while retaining the initially mentioned short free web trains, for increasing the drying capacity there are air amounts greater than before allowed to flow through the pockets without creating thereby the risk of increased web flutter and more frequent web breaks.

According to a further embodiment, the air carrier box features a "first" sealing strip, which deflects an air boundary layer which arrives with the wire by way of the first cylinder. Moreover, a preferably concavely curved guide wall may be provided for a fluidically favorable deflection of the air boundary layer. This guide wall may, along with the previously mentioned diverging wall, favorably form an assembly which likewise serves to reinforce the air carrier box. Said box, as is generally known, must extend crosswise through the entire dryer. It features therefore a length that matches the web width and may be in the order of 10 meters.

In a further embodiment of the invention, the air carrier box, viewed in cross section, may be subdivided in two box sections. In detail, the following is provided here: an outer box part forms the so-called sealing gap (for instance by means of a "second" sealing strip) and serves to supply the preferably hot blowing air. A smaller box part is located between the outer box part and the wire guide roll. Extending between the two box parts, which are joined by ribs or partitioning walls, is an air channel between two each of the ribs or partitioning walls. Said channel connects the air carrier box side facing the first cylinder with the opposite, so-called blow side of the air carrier box. The interior of the outer box part connects via driver jet orifices with the air channel, so that the supplied air flows at high velocity through the air channel to the blow side. On the air carrier box side facing the first cylinder, each air channel has at least one inlet opening fashioned as ejector-shaped suction opening. Here, a vacuum is generated with the aid of the driver jets. Additional suction channels may be provided in said inner box part. These then connect the space located between wire guide roll and air carrier box with the air channel. As a result, a maximum of air is sucked out of the gore located between the wire guide roll and the wire approaching it, in order to extensively prevent here the creation of pressure. The shell of the wire guide roll may for the same purpose feature peripheral grooves.

The inner box part preferably has a third sealing strip which bears on the free peripheral part of the wire guide roll; it prevents the pressure prevailing on the blow side to propagate in the direction of the aforementioned gore.

According to a further embodiment, a particularly simple design can be obtained by the following measures: the air carrier box has on the blow side numerous holeor slot-shaped simple blow openings, so that the desired pressure will be created in the pressure zone (bounded again by the sealing gap). The air carrier box features again in the area of said leaving point a "first" sealing strip for deflection of the air boundary layer flow, and a third sealing strip on the free peripheral part of the wire guide roll. Owing to this pair of sealing strips and the high wire velocity, a vacuum zone is created between the air carrier box and the wire departing from the first cylinder, which vacuum zone is defined, among others, by the two sealing strips and the wire guide roll. The buildup of pressure in the gore between wire and wire guide roll is prevented (or at least limited) by providing the shell of the wire guide roll with peripheral grooving.

BRIEF DESCRIPTION OF THE DRAWINGS

The invention will be described hereafter with the aid of the drawing.

DETAILED DESCRIPTION OF THE INVENTION

Figure 1:
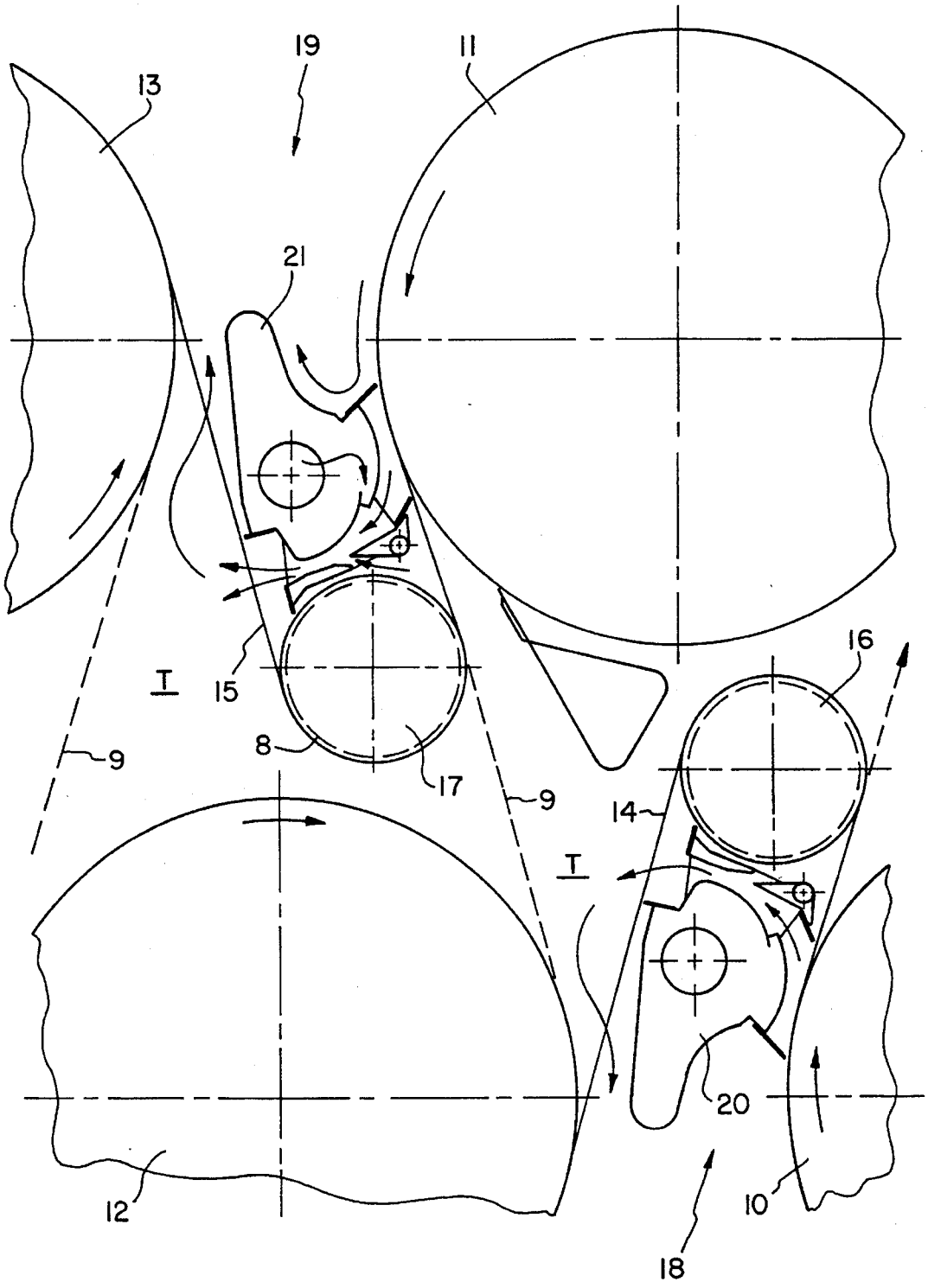
FIG. 1 shows a schematic section of a longitudinal section through a two-wire dryer.

Visible in FIG. 1, of a two-wire cylinder dryer, are a first heatable drying cylinder 11 and a same second cylinder 13 of an upper cylinder row, and additionally two cylinders 10 and 12 of a lower cylinder row. A paper web 9 indicated by dashed lines meanders alternately over the upper and lower cylinders; it is pushed on the lower cylinders 10, 12 by a lower endless wire 14 and on the upper cylinders 11, 13 by an upper endless wire 15. Each of the wires 14, 15 runs between two adjacent cylinders across a wire guide roll 16, 17. Each of the wire guide rolls is arranged in such a way that the paper web 9 and the respective wire 14 or 15 depart jointly from each of the cylinders and have a common path up to the wire guide roll. Only then continues the paper web without support by one of the wires to the opposite cylinder of the other cylinder row.

The space contained between the two adjacent cylinders (for instance 11, 13) and defined by the path of the wire 15 to the wire guide roll 17 and back again will hereafter be called "shaft" 18, 19. Contained in each shaft is an air carrier box 20, 21. Upper and lower air carrier boxes may be of identical design, such as illustrated in FIG. 1; but different configurations are conceivable as well. Each of the air carrier boxes 20, 21 serves several purposes: it generates at the leaving point of the web from the "first" cylinder 10, 11 in a "first part of the shaft, " i e., between the air carrier box and the cylinder delivering the web, a vacuum serving to suck the paper web 9 on the respective wire 14, 15. The objective of this measure is to achieve a smooth running of the web also at very high operating speeds (in the order of 1500 m/min), so as to reduce the risk of web breaks. On the opposite side of the air carrier box, namely in a "second part of the shaft," pressure is to be created. To that end, preferably dry, hot air is supplied with the aid of the air carrier box and blown through the wire. The hot air proceeds on this path into the so-called pocket T, absorbs there the water vapor (billows) emanating from the paper web and leaves the pocket thereafter, partly through the pocket ends on the two machine sides, but for the most through the respective wire upward or downward.

Figure 2:
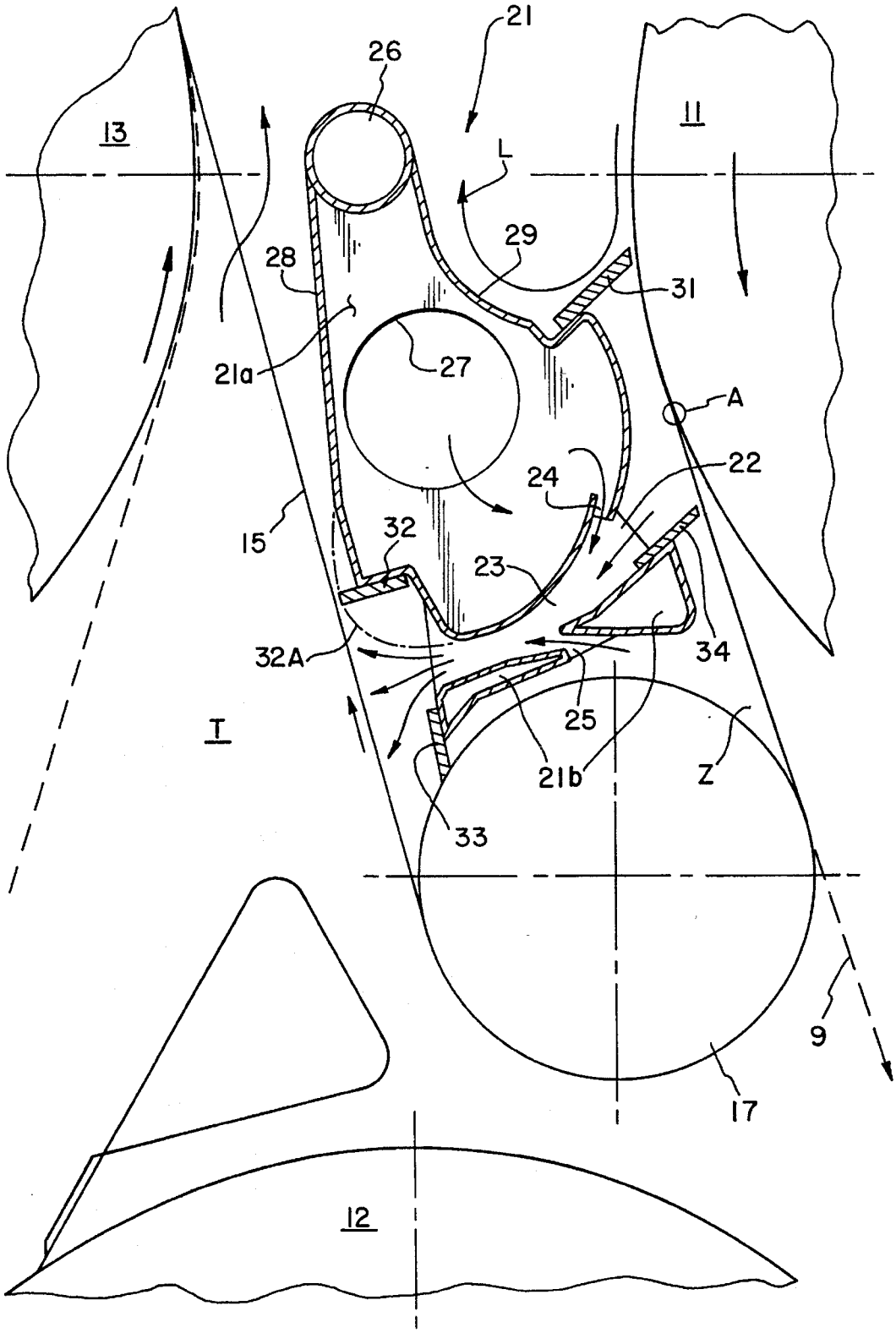
FIG. 2 shows a detail of FIG. 1, scaled up.

The following details of the air carrier box 21 are more clearly visible in FIG. 2: A certain distance from the leaving point A, the air carrier box features a first sealing strip 31 which extends up close to the wire proceeding over the cylinder. The sealing strip 31 and the guide wall 29 bordering on it and having preferably a concave curvature deflect the air boundary layer (arrow L) arriving with the wire 15 to the outside. Instead of the first sealing strip 31, a prior blow slot blowing against the direction of wire travel could be provided for the same purpose; but a mechanically acting sealing strip 31, for instance one formed by a felt strip, is preferred. Created on the back side of the sealing strip 31. i.e., in the area of the leaving point A, is a certain vacuum, already by the running wire 15. Said vacuum is augmented yet by the following measures:

The air carrier box 21 is subdivided in an outer, major part **21*a* serving to supply hot air and supporting the said first sealing strip 31, and an inner box part 21*b* extending along the free peripheral part of the wire guide roll 17. The two box parts 21*a* and 21*b* are joined by numerous ribs, or partitioning walls, 22, which are distributed across the machine width. Due to this design, the air carrier box 21 has several air channels 23 extending from the area of the leaving point A to the opposite side of the air carrier box, that is, in the area where the wire 15 runs from the wire guide roll 17 to the second cylinder 13. The partitioning walls 22 guide the air flow in the running direction of the machine; that is, crosswise flows in the air channels 23** are precluded, at least very extensively.

At least one driver nozzle 24 empties in each air channel 23. Said nozzle carries hot air from the interior of the box part **21*a* into the air channel 23 and through it toward the wire 15. The area of gore Z, which is bounded by the wire 15 approaching the wire guide roll 17, is connected to the air channel 23 via at least one suction channel 25. As a result of the described setup, hot air is blown through the wire 15 into the pocket T while at the same time air is sucked out of the area of the leaving point A and out of the gore Z. In other words, on the side facing the first cylinder 11, of the air carrier box 21, a vacuum region is created, whereas a pressure zone is created on the opposite side. For bounding the pressure zone, a second sealing strip 32 or a bulge 32A** (indicated by dash-dot line) is provided on the outer box part 21*a*, extending close up to the wire 15 running to the second cylinder 13. Besides, the inner box part supports a "third" sealing strip 33 which is in contact with the free peripheral part of wire guide roll 17.

Figure 3:
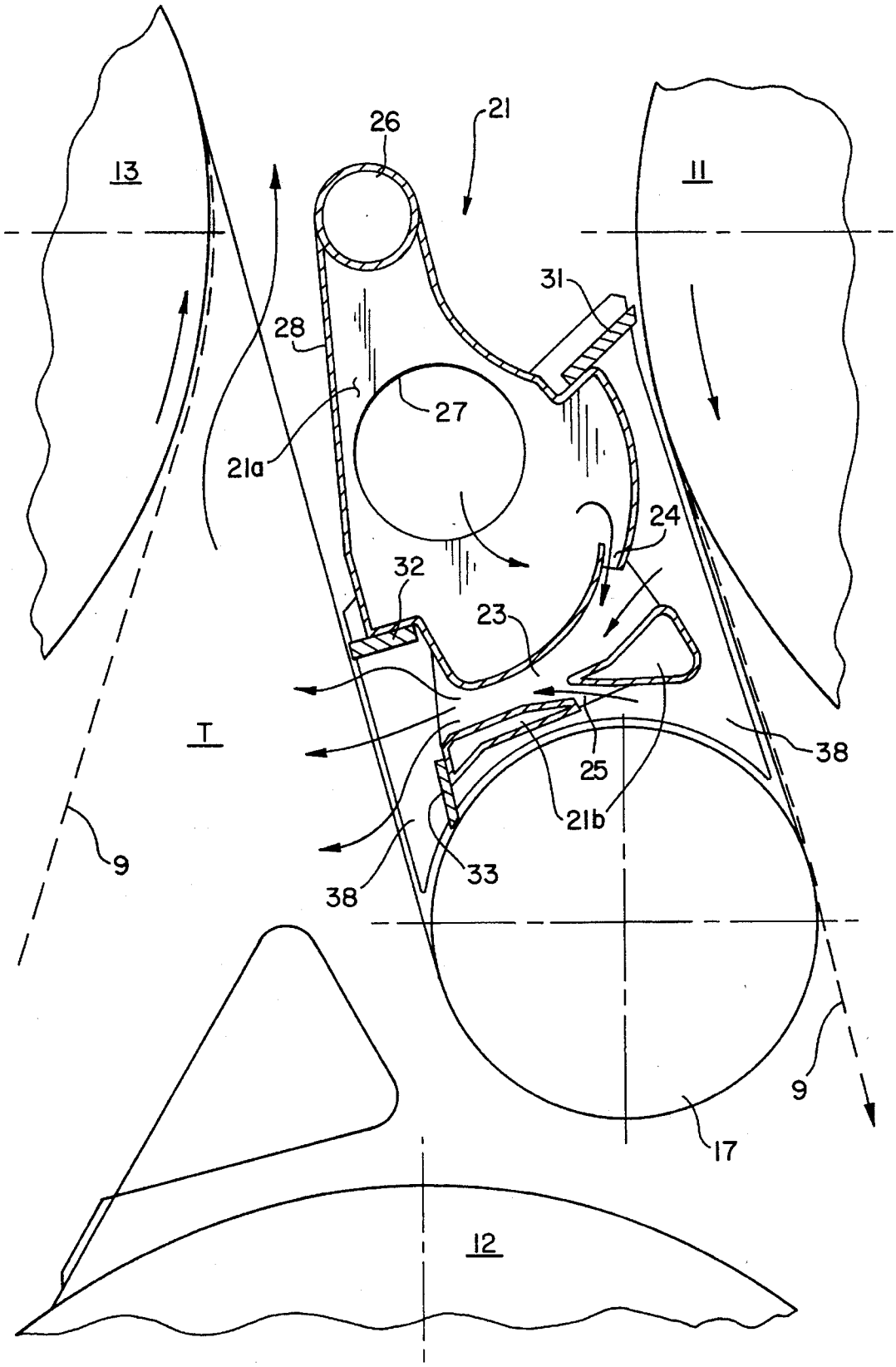
FIG. 3 shows a possible modification of FIG. 2, wherein the section is through the center main part of the air carrier box.

Lastly, the inner box part **21*b* may support, at the inlet to the air channel 23, a fourth sealing strip 34 which extends up close to the wire 15 leaving the first cylinder 11. As can be seen from FIG. 3, the latter, fourth sealing strip may be omitted, though. FIG. 3 shows as an example for all embodiments that an end wall 38 is provided on each end of the air carrier box, extending maximally close to the wire 15 and roll 17**. This measure aims to extensively prevent a sideways influx (in the vacuum area) respectively escape (in the pressure zone) of leakage air.

Figure 4:
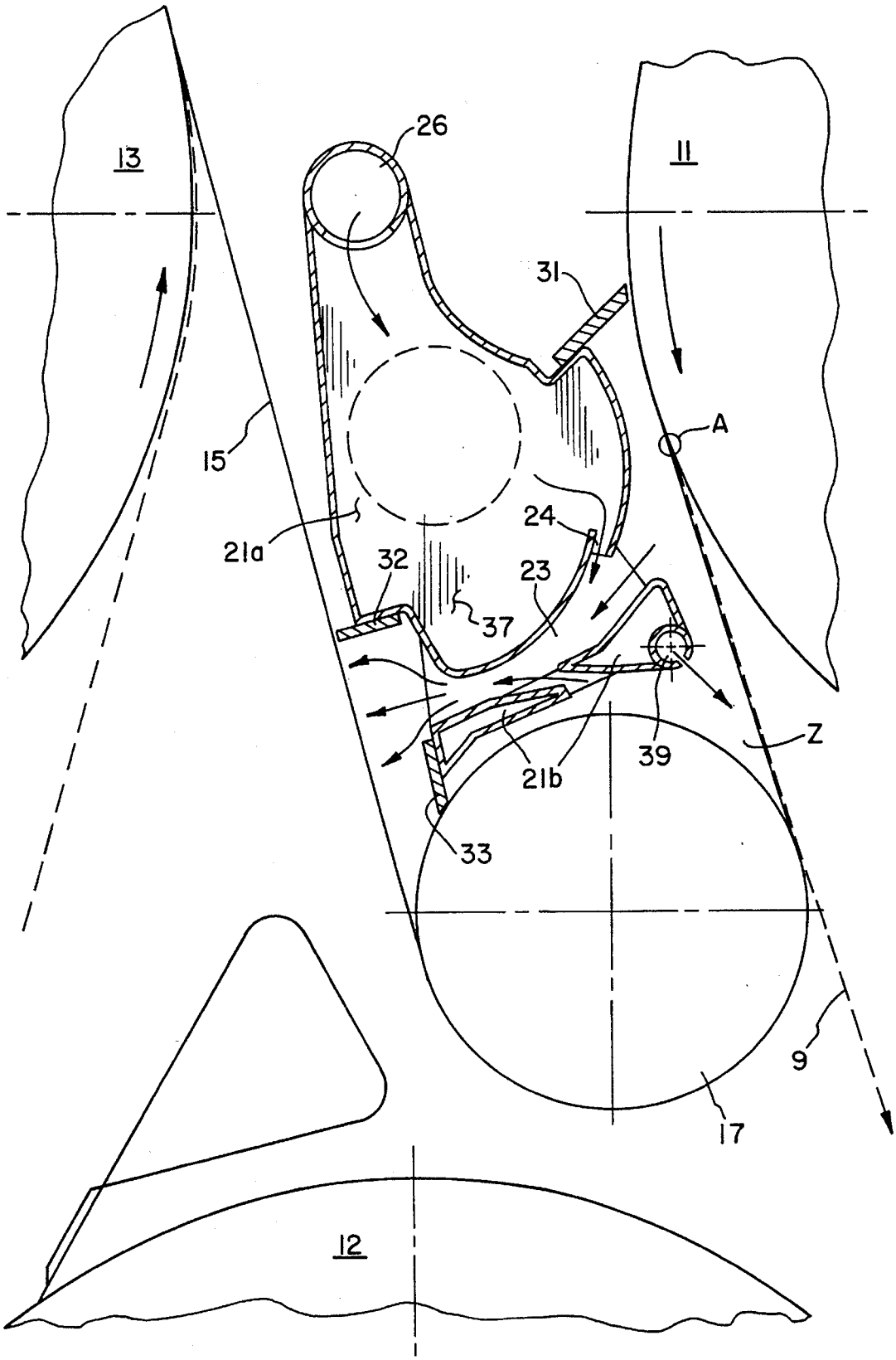
FIG. 4 corresponds to FIG. 3, wherein the section is through the so-called threading sliver region.

To facilitate an upward or downward escape of air enriched with water vapor from the pocket T (through the wire 15), the outer part **21*a* of the air carrier box has opposites the second cylinder 13 a wall 28 diverging from the wire 15. An entrance opening for hot air in the end face of the outer box part 21*a* is referenced 27. An additional air socket 26 may be provided for the so-called threading sliver area of the air carrier box, which is illustrated in FIG. 4. To separate the sliver area from the remaining part of the air carrier box, at least the outer box part 21*a* features a partition 37, so that the sliver area is supplied with air solely via socket 26. This makes it possible to create in the sliver area—as the paper machine is started or after a web break, i.e., in threading the so-called sliver (an edge strip of the paper web) in the dryer section—in the area of the leaving point A a vacuum higher than in the remaining part of the machine width. The air supply through inlet 27 can be interrupted by means of a not illustrated valve. FIG. 4 also shows that the air carrier box may in the sliver area feature a blow nozzle 39 directed at the gore Z. It carries the approaching sliver leader from the wire guide roll 17 to the following cylinder 12**.

Figure 5:
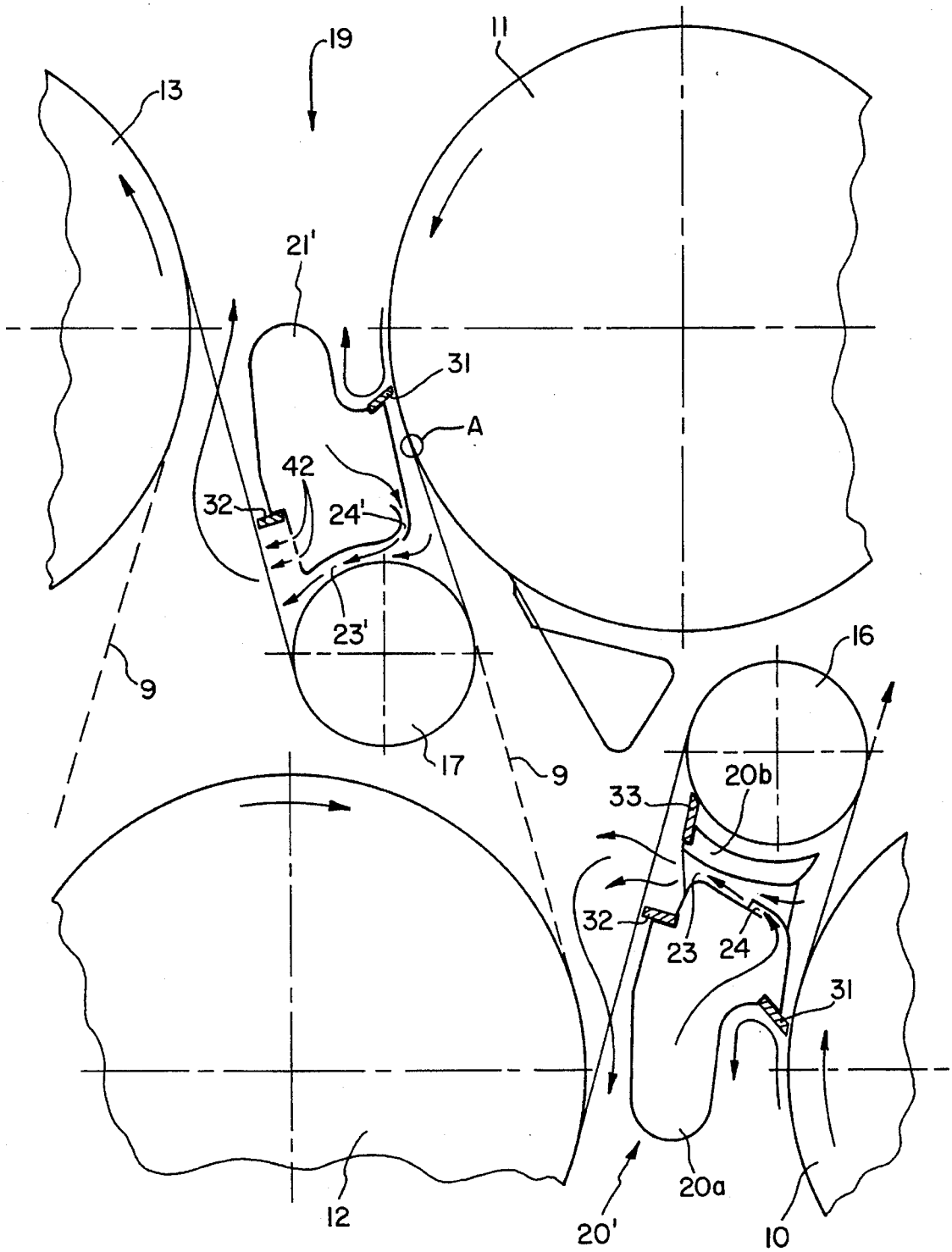
FIG. 5 and 6 show several arrangements varying from FIG. 1.

FIG. 5 shows different designs of air carrier boxes 20', 21' which are somewhat simplified as compared to FIG. 1, but have basically the same effect. The air carrier box 20' again is divided in an outer box part **20*a* and an inner box part 20*b* with an air channel 23 located in between and a driver nozzle 24 emptying into it. The same as in FIG. 3, the three sealing strips 31, 32 and 33 are provided for the same purpose. Omitted was the suction channel (25, FIG. 3) traversing the inner box part 20*b*. The single-part air carrier box 21' forms together with the wire guide roll 17 an air channel 23' in which empties again a driver nozzle 24'. When needed, additional blow holes 42 may be provided in the pressure zone (bounded by the second sealing strip 32). The third sealing strip 33 (available on the air carrier box 20'**) is omitted.

Figure 6:
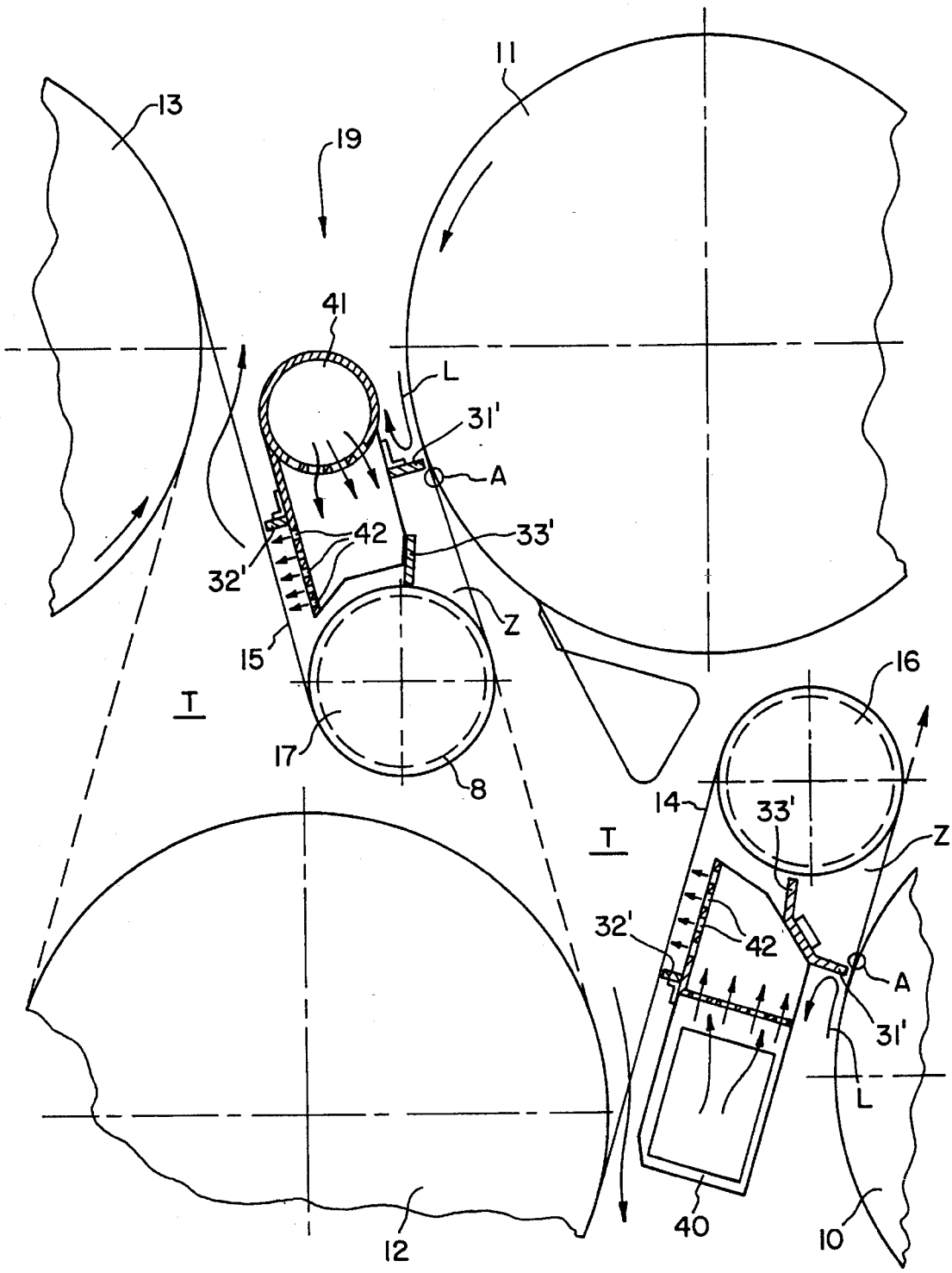

FIG. 6 shows further design variations of air carrier boxes 40, 41 which, for one, act as hot air blow boxes (similar to the air carrier boxes in FIG. 1 through 5 with a pressure zone bounded by means of a sealing strip 32', but with multiple blow openings 42) and, for another, support in the area of the leaving point A and the gore Z sealing strips 31' and 33', between which a vacuum zone is created during operation. The first sealing strip 31' again effects a deflection of the air boundary layer (arrow L) approaching with the wire. The wire guide rolls 16 and 17 have preferably a roll shell provided with peripheral grooves 8, so that any pressure building up in gore Z will be vented. Such peripheral grooving can preferably be provided also in the embodiments according to FIG. 1 through 5.

Figure 7:
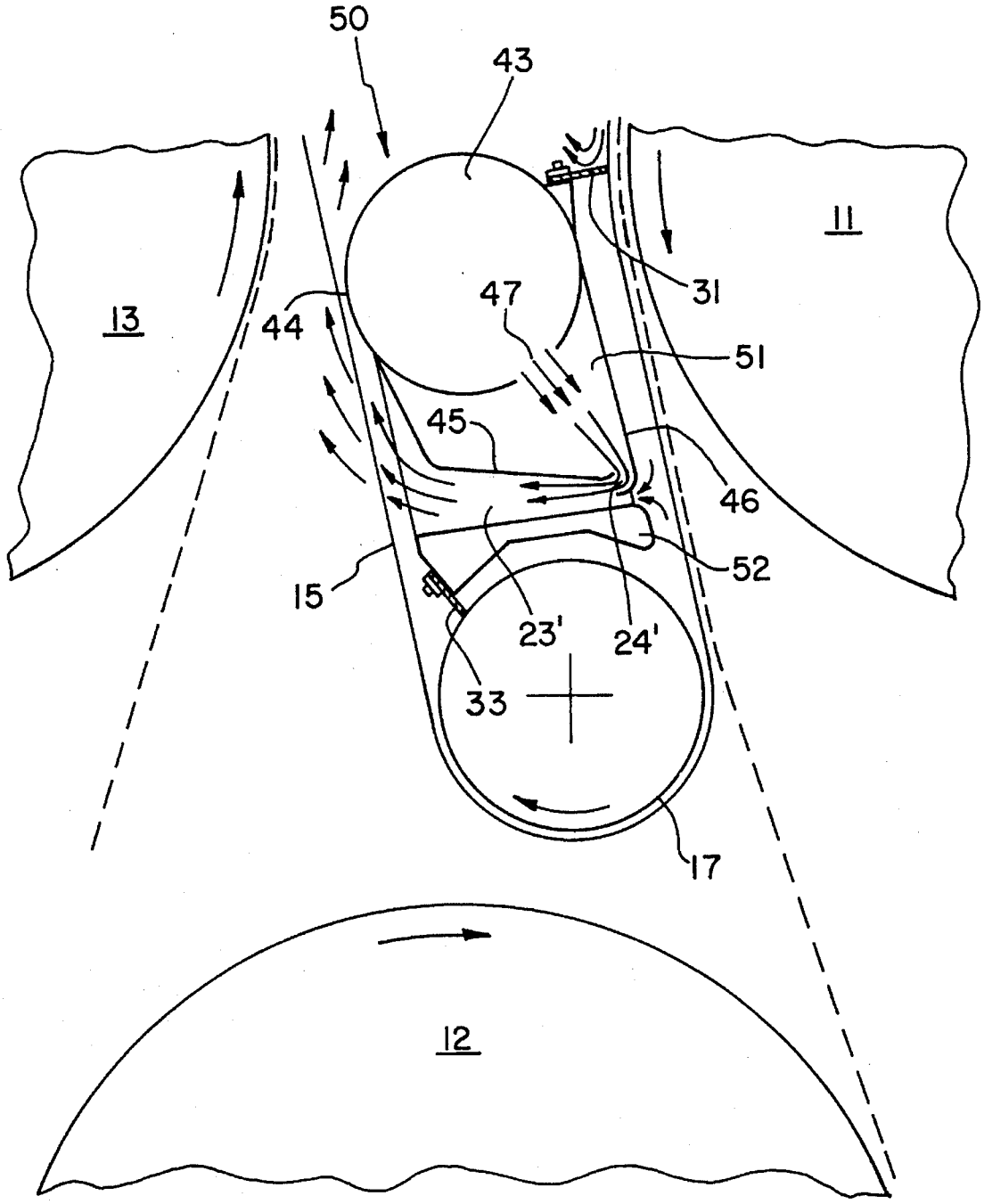
FIG. 7 shows a particularly suitable further configuration of the invention.

FIG. 7 depicts another variant of the air carrier box 50; it resembles essentially the air carrier box 20' in FIG. 5. The air boundary layer is deflected as well by a sealing strip 31. The outer box part 51 consists of a rounded support element 43 (for instance a support pipe) which at the same time serves to supply dry air and features air distribution openings 47; it has air guides 45 and 46 arranged in the direction toward the wire guide roll 17 and forming, together, the driver nozzle 24'. The bulge 44 of the support element 43, for one, forms together with the wire 15 a noncontact sealing gap and, for another, results in combination with the second cylinder 13 in a chimney type space. The driver nozzle 24 empties in an air channel 23' which is defined by the outer box part 51 and inner box part 52, which channel, in turn, features a sealing strip 33 bearing on the guide roll 17.

What is claimed is:

1. A two-wire cylinder dryer for drying a fiber web, comprising:

a plurality of heatable drying cylinders arranged in two tiered cylinder rows, said rows comprising an upper cylinder row and a lower cylinder row, with an upper endless wire coordinated with the upper cylinders in the upper cylinder row and a lower endless wire with the lower cylinders in the lower cylinder row, each of said wires having a running direction along a path through said dryer;

a wire guide roll situated between each cylinder row and between two adjacent cylinders in a cylinder row such that the web and endless wire proceed in mutual contact from an individual cylinder to the following wire guide roll, said adjacent cylinders comprising a first cylinder and a second cylinder, said web thereafter running freely from the wire guide roll to an opposite cylinder of the other cylinder row;

wherein a shaft is defined in each cylinder row by two adjacent cylinders, by the wire coordinated with said cylinders, and the wire guide roll situated between said cylinders;

an air carrier box arranged in said shaft and extending approximately parallel to the wire guide roll crosswise through the dryer, said air carrier box comprising means for generating a vacuum in a first part of the shaft, which first part extends between the air carrier box and the path of the wire from the first cylinder to the wire guide roll, to suck the web onto the wire;

said air carrier box further comprising means for generating pressure in a second part of the shaft, which second part is contained between the air carrier box and the path of the wire from the wire guide roll toward the second cylinder, and which is bounded by a sealing gap; and wherein said sealing gap comprises a bulge of the air carrier box and is positioned at said wire path from the wire guide roll to the second cylinder and is arranged approximately at a midpoint between the wire guide roll and the second cylinder, and wherein the air carrier box further comprises a wall diverging in relation to the wire running direction beyond the sealing gap along the path of the wire.

2. The dryer of claim 1, wherein the air carrier box supports a first sealing strip, said first sealing strip being positioned generally at a portion of the wire wherein the wire runs to the leaving point where the wire leaves the first cylinder, said first sealing strip being structured and arranged to deflect an air boundary layer approaching said air carrier box with the wire, wherein the air carrier box in flow direction behind the first sealing strip further comprises a guide wall which deflects the flow of the boundary air layer outward.

3. The dryer of claim 2, wherein said guide wall has a concave curvature.

4. The dryer of claim 1, wherein the air carrier box pressure generating means comprises, relative to the direction of wire travel, multiple blow openings, said multiple blow openings being situated before the sealing gap.

5. The dryer of claim 4, wherein the air carrier box vacuum generating means comprises, adjacent the wire proceeding to a leaving point of the wire from the first cylinder, a first sealing strip; and a further sealing strip bearing on the free peripheral part of the wire guide roll and separating the first shaft part and the second shaft part.

6. The dryer of claim 1, wherein the air carrier box, viewed in cross section, is by means of at least one air channel subdivided into an outer box part comprising the sealing gap and an inner box part extending along a free peripheral part of the wire guide roll, said outer box part comprising a rounded support element, said rounded support element comprising air distribution openings for supplying dry air.

7. The dryer of claim 6, wherein the rounded support element further comprises air guides, said air guides configured and combined such that a nozzle is formed by said combination.

8. The dryer of claim 1, wherein the bulge is followed by the wall diverging from the wire path.

9. The dryer according to claim 1, wherein said diverging wall, said bulge and said second cylinder define a chimney type space.

10. The dryer of claim 1, wherein the sealing gap comprises a noncontact type member.

11. The dryer of claim 1, wherein the air carrier box comprises a driver nozzle for generating said vacuum and said pressure, which feeds air from the first part of the shaft to the second part of the shaft by means of an ejector effect.

12. A two-wire cylinder dryer for drying a fiber web, comprising:

a plurality of heatable drying cylinders arranged in two tiered cylinder rows, said rows comprising an upper cylinder row and a lower cylinder row, with an upper endless wire coordinated with the upper cylinders in the upper cylinder row and a lower endless wire with the lower cylinders in the lower cylinder row, each of said wires having a running direction along a path through said dryer;

a wire guide roll situated between each cylinder row and between two adjacent cylinders in a cylinder row such that the web and endless wire proceed in mutual contact from an individual cylinder to the following wire guide roll, said adjacent cylinders comprising a first cylinder and a second cylinder, said web thereafter running freely from the wire guide roll to an opposite cylinder of the other cylinder row;

wherein a shaft is defined in each cylinder row by two adjacent cylinders, by the wire coordinated with said cylinders, and the wire guide roll situated between said cylinders;

an air carrier box arranged in said shaft and extending approximately parallel to the wire guide roll crosswise through the dryer, said air carrier box comprising means for generating a vacuum in a first part of the shaft, which first part extends between the air carrier box and the path of the wire from the first cylinder to the wire guide roll, to suck the web onto the wire, said air carrier box supporting a first sealing strip, said first sealing strip being positioned generally at a portion of the wire wherein the wire runs to the leaving point where the wire leaves the first cylinder, said first sealing strip being structured and arranged to deflect an air boundary layer approaching said air carrier box with the wire, wherein the air carrier box in flow direction behind the first sealing strip comprises a guide wall which deflects the flow of boundary air layer outward;

said air carrier box further comprising means for generating pressure in a second part of the shaft, which second part is contained between the air carrier box and the path of the wire from the wire guide roll toward the second cylinder, and which is bounded by a sealing gap, said sealing gap being defined by a second sealing strip; and wherein said sealing gap is positioned at said wire path from the wire guide roll to the second cylinder and is arranged approximately at a midpoint between the wire guide roll and the second cylinder, and wherein the air carrier box further comprises a wall diverging in relation to the wire running direction beyond the sealing gap along the path of the wire.

13. The dryer of claim 12, wherein the air carrier box, viewed in cross section, is by means of at least one air channel subdivided into an outer box part comprising the sealing gap and an inner box part extending along a free peripheral part of the wire guide roll, and wherein said air channel communicates with said first shaft part via ejector type suction openings.

14. The dryer of claim 13, further comprising a third sealing strip for separating the first part of the shaft from the second part of the shaft, wherein said third sealing strip bears on said free peripheral part of the wire guide roll.

15. The dryer of claim 14, further comprising a fourth sealing strip in the area of travel of the wire path from the first cylinder to the wire guide roll, said fourth sealing strip disposed on said inner box part of the air carrier box.

16. The dryer of claim 13, wherein said inner box part of the air carrier box includes a threading sliver area, wherein a blowing system directed at a gore defined between the wire guide roll and the wire approaching it is situated in laid threading sliver area.

17. The dryer of claim 16, wherein in said threading sliver area from said air channel, a channel part is partitioned off to which feed air can be admitted separately from a remaining part of the air carrier box, and which includes a plurality of suction openings.

18. The dryer of claim 13, wherein the inner box part of the air carrier box features additional suction openings, wherein said additional suction openings empty into said air channel.

* * * * *